United States Patent [19]

Hayashi et al.

[11] 4,079,704

[45] Mar. 21, 1978

[54] INTERNAL COMBUSTION ENGINE

[75] Inventors: Yoshimasa Hayashi, Yokohama; Tadashi Nagai, Yokosuka, both of Japan

[73] Assignee: Nissan Motor Company, Ltd., Japan

[21] Appl. No.: 679,861

[22] Filed: Apr. 23, 1976

[30] Foreign Application Priority Data

Apr. 25, 1975 Japan ..... 50-56656[U]

[51] Int. Cl.[2] ..... F01P 9/04

[52] U.S. Cl. ..... 123/41.57; 123/41.77; 123/41.85; 123/188 GC; 123/188 M; 123/188 S

[58] Field of Search ..... 123/41.85, 188 S, 41.31, 123/41.57, 41.72, 41.76, 41.77, 41.82, 188 M, 188 GC

[56] References Cited

U.S. PATENT DOCUMENTS

| | | | |
|---|---|---|---|
| 2,593,769 | 4/1952 | Kollsman | 123/188 S |
| 2,696,810 | 12/1954 | Kuepfer | 123/188 S |
| 3,102,381 | 9/1963 | Tryhorn | 123/41.85 |

*Primary Examiner*—Charles J. Myhre
*Assistant Examiner*—Daniel J. O'Connor

[57] ABSTRACT

An internal combustion engine has a cylinder head formed with a cooling liquid passageway and an air space. The cylinder head has a combustion chamber cooled by cooling liquid flowing through the passageway and an exhaust valve and exhaust port passage cooled by cooling air conducted by the air space. An insulating air space surrounds an exhaust port passage extending from the exhaust valve. As a result cooling effect by the cooling air on exhaust gas flowing through the exhaust port passage is reduced.

3 Claims, 2 Drawing Figures

INTERNAL COMBUSTION ENGINE

The present invention relates to an internal combustion engine, and more particularly to a liquid cooled internal combustion engine.

In the conventional liquid cooled internal combustion engines, a cooling liquid must be conducted around a combustion chamber to cool the same and also around an exhaust valve, from which an exhaust port passage extends, to cool the same. A cylinder head is formed with a passageway, through which the cooling liquid flows, and this passageway must also surround the exhaust port passage to conduct the cooling liquid around the exhaust valve.

As the exhaust port passage is surrounded by the cooling liquid passageway, exhaust gas flowing through the exhaust port passage is considerably cooled by the cooling liquid and temperature drop of the exhaust gas within the cylinder head due to the cooling liquid presents a problem that oxidation reaction of the exhaust gas within a thermal reactor will slow down or stop. It is therefore required to reduce the temperature drop.

A main object of the present invention is to provide an internal combustion engine in which effect of a cooling liquid on an exhaust port passage is minimized.

A specific object of the present invention is to provide an internal combustion engine in which heat transfer from exhaust gas flowing through an exhaust port passage toward a cylinder head is minimized.

Figure 1:
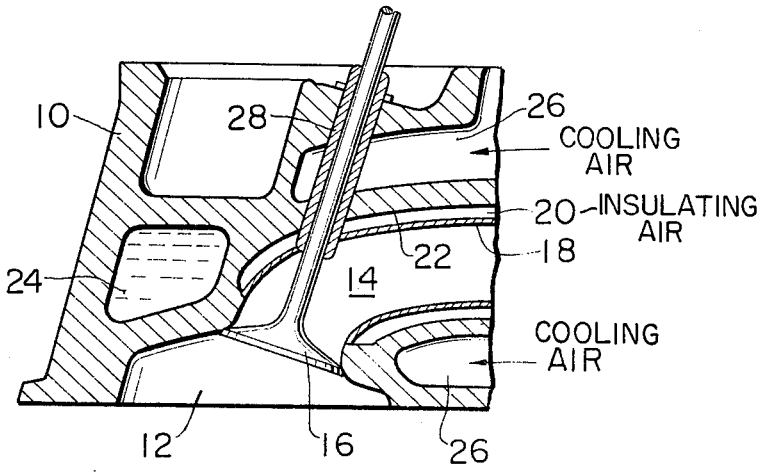
Figure 2:
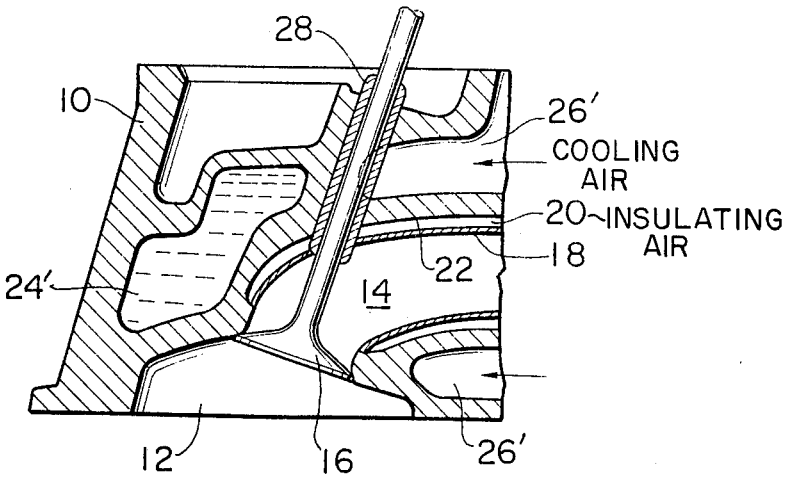

The above objects, features and advantages of the present invention will become clear from the following description in connection with the accompanying drawings, in which:

FIG. 1 is a sectional view of a cylinder head of an internal combustion engine, showing a preferred embodiment according to the present invention; and FIG. 2 is a similar view to FIG. 1, showing another preferred embodiment according to the present invention.

Referring to FIG. 1 an internal combustion engine comprises a cylinder head 10 having a combustion chamber 12, an exhaust port passage 14 and an exhaust valve 16. Installed within the exhaust port passage 14 is a tubular port liner 18 with an insulating space 20 between the port liner 18 and a passage inner wall 22. The cylinder head 10 is formed with a cooling liquid passageway 24 with which the combustion chamber 12 contacts to be cooled by cooling liquid flowing through the passageway 24. Formed also in the engine head 10 is an air space 26 through which cooling air flows. The space 26 surrounds outer periphery of at least a portion of a valve guide 28 of the exhaust valve 16 to cool the valve guide 28. Preferably the space 26 surrounds approximately 70 per cent of all of the exterior surface of the exhaust port passage 14.

It is to be noted from the preceding that the air space 26 surrounding the exhaust port passage 14 reduces the effect of the cooling liquid on the exhaust gas.

It is also to be noted that amount of heat transfer from the exhaust gas toward the cylinder head 10 decreases effectively due to the installation of the port liner 18 within the exhaust port passage 14.

It is to be noted that in the internal combustion engine shown in FIG. 1 the combustion chamber 12 is mainly cooled by cooling liquid flowing through the passageway 24, while the exhaust valve 16 is cooled by air within the space 26. To meet with an increase of thermal load on the exhaust valve 16 as a result of the use of air as its cooling source, the material of the exhaust valve 16 should be selected from high heat resisting metals or alloys.

When it is necessary to lower the thermal load applied on the exhaust valve a cooling liquid passageway 24' with which a combustion chamber 12 is cooled, contacts also with a portion of a valve guide 28 of an exhaust valve 16 to effectively cool the same, as illustrated in FIG. 2. In this embodiment an air space 26' surrounds a portion of the valve guide 28.

It will be appreciated that according to the present invention, since the exhaust port passage is surrounded by the air space we contact with the exhaust valve to be cooled by air within the air space, excessive temperature drop of the exhaust gas flowing through the exhaust port passage, which would exist if a cooling liquid passageway surrounds an exhaust port passage, is alleviated.

What is claimed is:

1. An internal combustion engine having a cylinder head closing a combustion chamber said cylinder head comprising:

a wall defining a bore extending through to the combustion chamber;

a tubular port liner arranged within said bore, said tubular port liner defining an exhaust port passage, an insulating air space sealed from said exhaust port passage defined by said tubular port liner and said wall said insulating air space surrounding said tubular port liner;

cooling liquid passageway means through which a cooling liquid flows for cooling said combustion chamber and air space means through which cooling air flows for cooling said wall defining said bore extending to the combustion chamber.

2. In an internal combustion engine as claimed in claim 1, in which said air space means surrounds approximately 70 per cent of all of the surface area of said wall.

3. In an internal combustion engine as claimed in claim 2, in which said cooling liquid passageway means is arranged to cool an exhaust valve for said exhaust port passage.

* * * * *